US006513554B1

(12) United States Patent
Hellström et al.

(10) Patent No.: US 6,513,554 B1
(45) Date of Patent: Feb. 4, 2003

(54) YARN PROCESSING SYSTEM AND METHOD TO OPERATE A YARN PROCESSING SYSTEM

(75) Inventors: Jerker Hellström, Nol (SE); Tomas Rundberg, Vallda (SE); Lars Helge Gottfrid Tholander, Haverdal (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/913,784

(22) PCT Filed: Feb. 15, 2000

(86) PCT No.: PCT/EP00/01230

§ 371 (c)(1),
(2), (4) Date: Apr. 11, 2002

(87) PCT Pub. No.: WO00/49474

PCT Pub. Date: Aug. 24, 2000

(30) Foreign Application Priority Data

Feb. 15, 1999 (SE) ..... 9900510

(51) Int. Cl.[7] ..... D03D 47/36

(52) U.S. Cl. ..... 139/1 R; 139/452; 66/125 R; 700/90; 340/825.52

(58) Field of Search ..... 700/90; 340/825.52; 395/250, 275; 139/452, 1 R; 66/125 R; 364/470, 921.1

(56) References Cited

U.S. PATENT DOCUMENTS 5,246,039 A * 9/1993 Fredriksson ..... 139/1 R
5,285,821 A * 2/1994 Fredriksson ..... 139/1 R

FOREIGN PATENT DOCUMENTS

| | | |
|---|---|---|
| EP | 0 458 874 | 12/1991 |
| GB | 2 322 262 | 8/1998 |
| WO | WO 92/03881 | 3/1992 |
| WO | WO 96/12993 | 5/1996 |
| WO | WO 98/50833 | 11/1998 |

* cited by examiner

*Primary Examiner*—John J. Calvert
*Assistant Examiner*—Robert H. Muromoto, Jr.
(74) *Attorney, Agent, or Firm*—Flynn, Thiel, Boutell & Tanis, P.C.

(57) ABSTRACT

A yarn processing system includes a yarn consuming textile machine and at least one yard feeding device, each having electric drive means and electronic control and/or monitoring means. The yarn processing system includes data transmission paths for mutual transmissions between the control and/or monitoring means wherein each of the control and/or monitoring means contains one communication microprocessor for serial or serial and digital transmission of data representing information types in the form of a communication protocol. The information types differ in ranking with real-time transmission priority of at least the information type of the highest ranking. In each control and/or monitoring device, the communication microprocessor is connected with a stationary radio transmitter/receiver for carrying out the data transmission via wireless transmission paths within a frequency band available for industrial applications, and between the communication microprocessor and the radio transmitter/receiver a radio media access control interface means is provided. Operation of the yarn processing system is controlled and monitored by data radio transmission within a frequency band as available for industrial applications wherein any information of any information type as provided by a communication microprocessor is converted by the radio media access control interface means into a radio message transmitted by said radio transmitter/receiver to at least one other distant radio transmitter/receiver and then is reconverted into said information type for at least one other communication microprocessor.

11 Claims, 1 Drawing Sheet

YARN PROCESSING SYSTEM AND METHOD TO OPERATE A YARN PROCESSING SYSTEM

FIELD OF THE INVENTION

The invention relates to a yarn processing system having a group of functionally interrelated components including a yarn consuming textile machine and to a method of operating the yarn processing system.

BACKGROUND OF THE INVENTION

Already known computerised yarn processing systems, such as a weaving machine with its associated feeding and accessory components, are equipped with complex multi-line wiring for transmitting signals between interconnected operation elements and to associated control and/or monitoring means. Said wiring extends between all components of the component group of the yarn processing system.

Each of EP-A-0 458 874 and WO 92/03881 A discloses a method and structural means for controlling and/or monitoring a yarn processing system with the help of a two-line field bus for the transmission of messages in the form of a quick communication protocol with information types differing in their respective priorities in order to achieve real-time transmission at least for highest priority information using the same field bus as lower priority information types. The wiring thus can be simplified by the two-line field bus and, due to the communication protocol of special communication microprocessors, at the interfaces with the field bus. However, in order to connect all transmission participants to the field bus, the field bus has to be integrated in the crowded environment of the yarn processing system at locations where mounting space and access are severely restricted. The field bus is vulnerable to damage. The entire system has to have a complicated layout configuration. Damage to the field bus easily causes breakdowns of the communication microprocessors.

WO 98/50833 discloses an automated residence management system using radio frequency communication between sub-systems and appliances remotely located in a plurality of residences and other spaces to operate in a centrally controlled manner, e.g. in private homes, apartment buildings, office buildings, and other occupied spaces and structures. Radio transmission takes place with a variable transmission/reception frequency such that the current and variable frequencies hop between two or more frequencies in synchronisation. A spread spectrum communication technique in the 900 MHz transmission range is recommended. Typical examples of such sub-systems are water heaters, lights, security systems, internal telephone wiring systems, gas meter, electric meter, water meter, hot tubes, clothes dryer, etc.

It is a task of the invention to provide a more reliable and flexible computerised yarn processing system as well as provide a method to operate and control said yarn processing system in a more reliable and flexible fashion.

Said task is achieved by providing a communication microprocessor in each electronic control and/or monitoring means of a yarn processing system wherein the microprocessor is connected to a radio transmitter/receiver for data transmissions between components. The method of operating this system includes generating control and/or monitoring data and converting this data into radio signals which are transmitted and received by the radio transmitter/receiver.

Radio transmissions within a frequency band, such as that available for industrial applications and via wireless transmission paths, avoid the necessity of designing a complicated field bus layout configuration. The transmission participants are communicating with each other by radio transmissions. This leads to a comfortable modular interchangeability of the transmission participants. In case of transmission failures or disturbances, the danger of damages for other transmission participants is reduced. Each component or a component group can easily be pre-fabricated independently from others and by other manufacturers. The necessary compatibility is easy to be achieved and allows an advantageous modular composition of different yarn processing systems based upon standardizable base components. In one and the same yarn processing system, a radio transmission system or several separate systems can be provided using a common frequency in the 2.4 GHz or 400 MHz band. Since in a radio transmission system all participants are able to listen to or output information without the restriction of a structural field bus as in prior art, particular care is necessary for the reliability of the respective information to be transmitted or received. This radio specific task is fulfilled by the radio media access control interface means responsible for the organisation and conversion of the information into the radio signals, as well as the evaluation of the incoming radio signals. Modern radio transmitters/receivers for industrial applications with a reach of about 10 meters as well as said radio media access control interface means are available for a fair price and with reliable operational behaviour and are easy to be integrated in existing electronic control and/or monitoring means. Even though said radio media access control interface means constitute additional administrative overhead equipment in the system, the most important advantage is the avoidance of structural field bus wiring while still taking advantage of a quick and reliable communication protocol.

In a further embodiment even, further active yarn processing accessory components are integrated in the radio transmission system for control and/or monitoring purposes. A pre-requisite for said accessory components is an electronic control and/or monitoring means, a power supply, a communication microprocessor and the radio media access control interface means for its radio transmitter/receiver. Also in said accessory components of the yarn processing system sensors, yarn brakes, yarn clamps, tensiometers, yarn cutters, yarn selectors, yarn conveyors, etc., will receive or output ratio transmitted data.

It is advantageous to use radio transmitters/receivers according to TDMA-standards i.e. a form of radio transmissions as used by GSM-mobile telephone systems. Alternatively, radio transmitters/receivers can be used according to the CDMA-standards which is a more sophisticated form of radio transmissions with increased reliability and high disturbance safety level.

Said radio media access control interface means could be constituted by software only in said communication microprocessor or in an associated microprocessor.

The communication microprocessor may be customised and apt to configure said different information types each with a frame having frame fields containing data. Said frame configuration is an ideal measure for quick and fail-safe serial or serial and digital transmission. By configuring said frames with at least one data frame field containing general prioritising data and/or individual addressing data, a real-time transmission for important information can be achieved when necessary for a real-time control and/or monitoring of a yarn processing system, or to transmit or receive information between particular selected participants in the transmission system only.

The high reliability and disturbance free radio transmission level in a yarn processing system could advantageously be further extended by using a hand-held controller for transmission and/or receipt of information in a wireless fashion or to form selected or not selected participants in the transmission system. Expediently said hand-held controller is used to set operation parameters or readout stored information. It can easily be equipped such that it is compatible with several yarn processing systems of similar or different kinds.

Participants in the transmission system are not only the yarn feeding devices and the textile machine itself but advantageously yarn sensor elements, drive means, drive operating means, tensiometers, yarn brakes, threading equipment, parameter setting and storing elements, etc., all of which are prepared to output or respond to data transmitted by the respective radio transmitters/receivers.

BRIEF DESCRIPTION OF THE DRAWINGS

The invention is explained with the help of the drawings which are described as follows.

DETAILED DESCRIPTION

Figure 1:
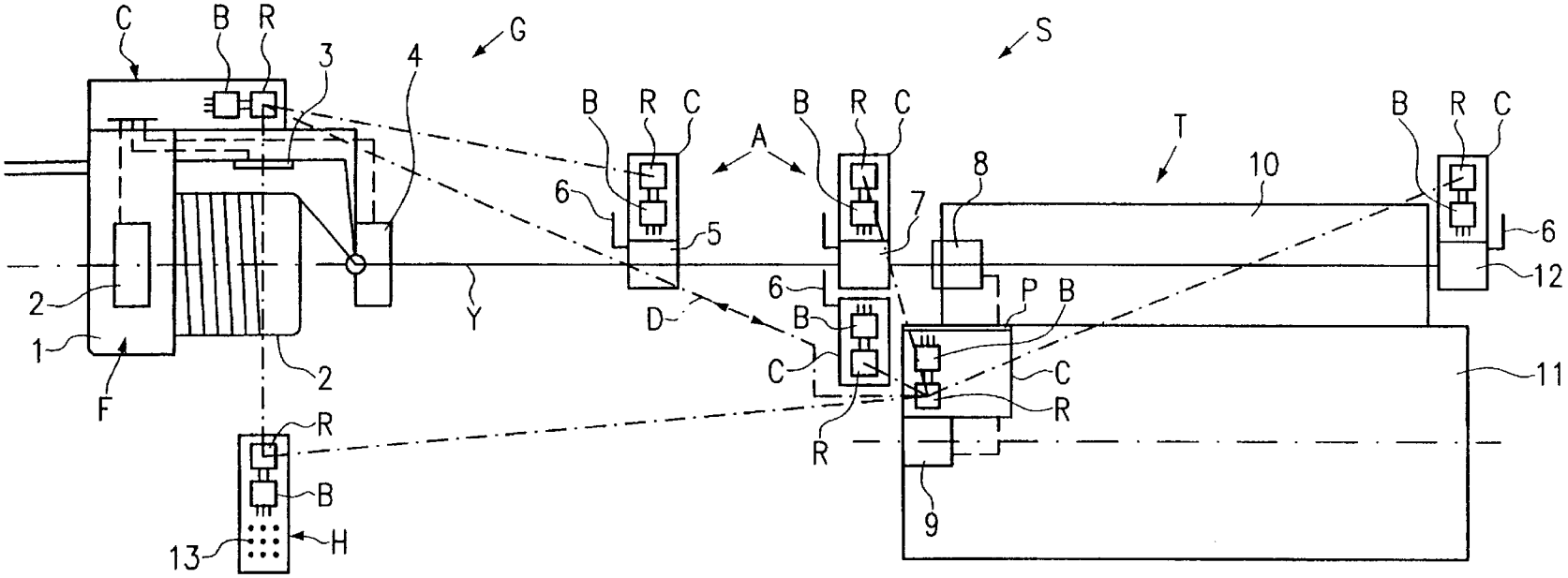
FIG. 1 is a schematic diagrammatic view of a yarn processing system.

A yarn processing system S comprises a yarn consuming textile machine T, like a weaving machine (as shown) or a knitting machine (not shown), at least one feeding device F, and, if needed, several yarn processing accessory components A, altogether forming a component group G designed and structured for mutual communication for controlling and/or monitoring the co-operation during operation of the components in the component group. Said communication is carried out by radio transmission on a wireless basis, preferably bi-directionally, and by using a quick communication protocol with information types differing in their relative ranking. This means that the information as transmitted has differing priorities with highest priority for information intended for real-time transmission, while lower ranking information types will have to wait to be transmitted when any higher ranking information is to be transmitted simultaneously. Highest priority information types are trig signals, stop signals, yarn breakage signals, and sync signals, which are necessary for the correct co-operation of the components of the component group G. Operation parameters, continuous operation signals, preparatory acceleration or deceleration commands belong to lower priority information types.

Even though only one feeding device F is shown in the drawing, said yarn processing system S might contain a plurality of such feeding devices F of similar or different design, each prepared for processing a yarn Y intended for the yarn consuming textile machine T.

Feeding device F has a drive means 2 in a housing 1 supporting a yarn storage drum 2' and comprising yarn processing or monitoring components like yarn sensors 3 or a yarn brake 4, e.g. at the outlet region of said feeding device F. Further yarn processing accessory components (not shown) could be provided at the inlet side (left-side) of the feeding device F, as well. Said accessory components 3, 4 are connected to the power supply of the feeding device or to their own power supply and are also connected to a control and/or monitoring means C of said feeding device F. Said control and/or monitoring means C is an electronic control circuit having a microprocessor controlling the drive motor 2, e.g. on the basis of signals generated by components 3, 4 and independent from the yarn consumption as well as depending on information received from the textile machine T. The control and/or monitoring means contains a communication microprocessor B and at least one radio transmitter/receiver R having an antenna assembly (not shown).

Said communication microprocessor B is designed for a quick communication protocol and serial or serial and digital transmission of information types differing from another information type in ranking such that an information type having the highest priority can be transmitted in real-time and has priority over other information types having a lower priority. Said communication microprocessor B is apt to provide said information on the basis of signals or data present in the control and/or monitoring means C for said radio transmitter/receiver R, but simultaneously is apt to derive data or signals from any information as received via its associated radio transmitter/receiver R for the components connected to said control and/or monitoring means C.

Downstream of the yarn feeding device F, an accessory component A, e.g. a yarn tensioner, yarn brake, or tensiometer 5 is provided having e.g. its own power supply 6 and having its own control and/or monitoring means C, again equipped with a communication microprocessor B and a radio transmitter/receiver R.

Close to the inlet of a shed 10 of said textile machine T, a further accessory component A is situated, namely a yarn cutting means, a yarn selector or an auxiliary insertion conveyor 7. The accessory component A has its own power supply or is connected to the power supply of the textile machine, and has its own control and/or monitoring means C containing a communication microprocessor B and a radio transmitter/receiver R.

In the entrance region of shed 10 of textile machine T, a further component 8, e.g. an insertion means, is provided, preferably connected to the power supply of a control and/or monitoring means C of the textile machine T. The component 8 is equipped with a communication microprocessor B and a radio transmitter/receiver R. At the rear end of shed 10, a further accessory component 12 is situated, e.g. an arrival sensor, having its own power supply 6 and a control and/or monitoring means C. Again, the component 12 is equipped with a communication microprocessor B and a radio transmitter/receiver R. Power supply for processor B or radio transmitter/receiver R could be a battery instead.

Finally, in textile machine T, a main control and/or monitoring means C is situated, e.g. close to the control and/or monitoring panel P of said textile machine T, to which panel P e.g. an only indicated drive means 9 of said textile machine T is connected. Also the main control and/or monitoring means C of textile machine T is equipped with at least one communication microprocessor B and an associated stationary radio transmitter/receiver R.

Furthermore, a hand-held controller H can be used as part of the yarn processing system S. Controller H has an indicating and input section 13, is designed on an electronic basis and contains a communication microprocessor B and a radio transmitter/receiver R and its own power supply, preferably a battery.

All radio transmitters/receivers R in the yarn processing system S are designed for mutual wireless transmission within a frequency band such as that available for industrial applications. Advantageously they are designed for ISMstandards and a frequency band of about 2.4 GHz. Instead they could be designed for a frequency band of about 400 MHz. The radio transmitters/receivers R as used could operate according to TDMA-standards like GSM-mobile telephone systems or according to CDMA-standard, a somewhat more sophisticated form of radio transmission.

Figure 2:
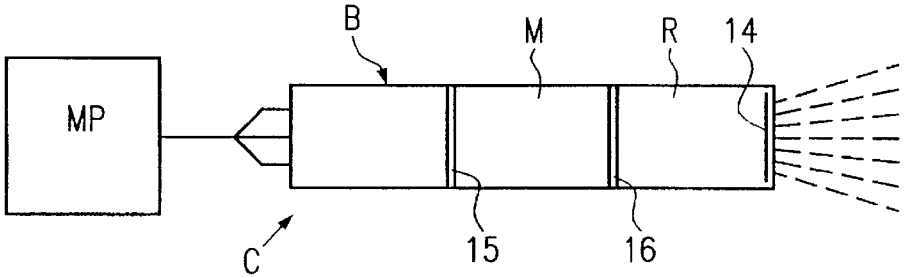
FIG. 2 is a schematic view of the primary part of a control and/or monitoring means as used in the yarn processing system of FIG. 1.

In FIG. 2, an essential part of each of the control and/or monitoring means C is shown. Within said control and/or monitoring means C, a microprocessor MP is connected to a communication microprocessor B which in turn is connected to its radio transmitter/receiver R. Between communication microprocessor B and transmitter/receiver R a radio media access control interface means M is situated, either in the form of hardware components or in the form of software constituted by communication microprocessor B itself or by an associated microprocessor (not shown). Radio transmitter/receiver R is equipped with an in-built antenna assembly 14. All of the above-mentioned components can be mounted to a common circuit board.

Provided that data signals received from microprocessor MP are to be transmitted by radio transmitter/receiver R, they are organised by said communication microprocessor B in order to form computer information of one of the above-mentioned different information types of the communication protocol. Since said information types cannot be transmitted by the radio transmitter/receiver R as they are, e.g. schematic indicated interfaces 15 and 16 are used, to first organise and handle the information as built up by communication microprocessor B for radio transmitter/receiver R and to translate via second interface 16 said organised or translated information into radio signals which then are transmitted by radio transmitter/receiver R, e.g. by frequency modulation (FM). Said radio media access control interface means M is an IC (integrated circuit) not only organising and handling the respective information for the radio transmitter/receiver R, but also organising and handling any radio transmitted received information back to communication microprocessor B which is then inputting the resulting signals or data into microprocessor MP. Radio media access control interface means M is an administrative overhead equipment for each control and/or monitoring means C and is necessary because all participants of the wireless radio transmission via transmission paths D simultaneously can be transmitting and/or receiving and thus need an administrative organisation within the transmission system, namely said radio media access control interface means M in each of the communicating control and/or monitoring means C.

What is claimed is:

1. A yarn processing system, comprising a functionally interrelated group of components including at least a yarn consuming textile machine and at least one yarn feeding device, at least said textile machine and said feeding device having electric drive means, and further, each of said components having electronic control and/or monitoring means, said yarn processing system further including data transmission paths for mutual data transmissions between said control and/or monitoring means of said components of said component group, each of said control and/or monitoring means having at least one communication microprocessor for providing different information types in the form of a communication protocol, said information types differing in ranking with at least the information type of the highest ranking having a real-time transmission priority wherein transmission of the highest ranking information type occurs in real time and takes priority over lower ranking information types, each said control and/or monitoring means including a stationary radio transmitter/receiver and said communication microprocessor in each said control and/or monitoring means being connected with said stationary radio transmitter/receiver which carries out said data transmission at a single common frequency via said transmission paths which are wireless within a frequency band of about 2.4 GHz or about 400 MHz available for industrial applications and with a reach in the range of about 10 meters, radio media access control interface means being provided between said communication microprocessor and said radio transmitter/receiver.

2. A yarn processing system as in claim 1, wherein said component group includes at least one active yarn processing accessory component having said electronic control and/or monitoring means including said communication microprocessor, said radio media access control interface means and said radio transmitter/receiver and at least one data responsive and/or data generating element communicating with said communication microprocessor.

3. A yarn processing system as in claim 1, wherein each said radio transmitter/receiver operates according to TDMA-standards or CDMA-standards.

4. A yarn processing system as in claim 1, wherein said radio media access control interface means is defined by software in said communication microprocessor or in another associated microprocessor.

5. A yarn processing system as in claim 1, wherein each information type comprises data for wireless transmission and wireless receipt by each of said radio transmitter/receivers, said data being configured by said communication microprocessor with a frame having data containing frame fields wherein at least one of said frame fields contains general prioritising data and/or individual addressing data for at least one of said control and/or monitoring means.

6. A yarn processing system as in claim 1, wherein said component group includes at least one hand-held controller which forms part of said yarn processing system or a group of yarn processing systems and includes said communication microprocessor, said radio media access control interface means and said radio transmitter/receiver for radio communication with at least one of the stationary radio transmitter/receivers.

7. A yarn processing system as in claim 1, wherein at least one onboard data responsive and/or data generating element is connected in each said yarn feeding device to set said control and/or monitoring means.

8. A method for operating a yarn processing system comprising the steps of:

providing a functionally associated group of components, including a yarn consuming textile machine and at least one yarn feeding device, at least said textile machine and said feeding device having electric drive means, and each of said components of said component group having electric control and/or monitoring means, each said control and/or monitoring means comprising a communication microprocessor, a radio transmitter/receiver and a radio media access control interface means;

transmitting serial or serial and digital transmissions of control and/or monitoring data within information of differing priorities and in the form of a communication protocol, said communication protocol being provided in each of said control and/or monitoring means by said communication microprocessors;

converting each information of one of the information types being provided by said communication microprocessor into a radio message by said radio media access control interface means associated with said communication microprocessor;

transmitting each said radio message in the form of a wireless radio transmission at a single common frequency within a radio frequency band available for industrial applications of about 2.4 GHz or about 400 MHz and within a reach of about 10 meters by a one said radio transmitter/receiver which said radio message is received by at least another said radio transmitter/receiver which is located distant from said transmitting radio transmitter/receiver; and reconverting each said radio message into a communication protocol information of said information type for the communication microprocessor of said receiving radio transmitter/receiver via said radio media access control interface means associated with said receiving radio transmitter/receiver.

9. A yarn processing system according to claim 2, wherein said data responsive and/or data generating element is one of a sensor, a yarn brake, a yarn clamp, a yarn tensiometer, a yarn cutter, a yarn selector and a yarn conveyor.

10. A yarn processing system according to claim 7, wherein said data responsive and/or data generating element is one of a yarn sensor, element drive means, a yarn tensiometer, a yarn brake, threading equipment, and an operation parameter setting and storing element.

11. A yarn processing system comprising:

a functionally interrelated group of components including at least a yarn consuming textile machine and at least one yarn feeding device, at least said textile machine and said feeding device having electric drive means, each of said components further comprising electronic control and/or monitoring means, said yarn processing system further including wireless data transmission paths for mutual data transmissions between said control and/or monitoring means of said components of said component group, each of said control and/or monitoring means comprising at least one communication microprocessor for providing different information types in the form of a communication protocol, said information types differing in ranking with at least the information type of a highest ranking having a real-time transmission priority wherein transmission of the higher ranking information type occurs in real time and takes priority over lower ranking information types, each said control and/or monitoring means including a stationary radio transmitter/receiver and said communication microprocessor in each said control and/or monitoring means being connected with said stationary radio transmitter/receiver which carries out said data transmission at a common frequency via said wireless transmission paths within a frequency band available for industrial applications, radio media access control interface means being provided between said communication microprocessor and said radio transmitter/receiver so as to convert each said information type into a radio message for transmission to other said components and reconverting said radio message received from other said components into said information type.

* * * * *